US012768296B2

(12) United States Patent
Ford et al.

(10) Patent No.: US 12,768,296 B2
(45) **Date of Patent: *Oct. 20, 2026**

(54) AUTOMOTIVE ELECTRIC LIQUID PUMP MODULE

(71) Applicant: PIERBURG PUMP TECHNOLOGY GMBH, Neuss (DE)

(72) Inventors: Gabriella Ford, Fountain Inn, SC (US); Stefano Fiorini, Fountain Inn, SC (US); Giorgio Peroni, Leghorn (IT); Brandon Woltz, Fountain Inn, SC (US); Eric Trombley, Fountain Inn, SC (US)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 299 days.

This patent is subject to a terminal disclaimer.

(21) Appl. No.: 18/293,362

(22) PCT Filed: Aug. 3, 2021

(86) PCT No.: PCT/EP2021/071666

§ 371 (c)(1),
(2) Date: Jan. 30, 2024

(87) PCT Pub. No.: WO2023/011708

PCT Pub. Date: Feb. 9, 2023

(65) Prior Publication Data

US 2025/0092816 A1 Mar. 20, 2025

(51) Int. Cl.

| | |
|---|---|
| ***B01D 53/22*** | (2006.01) |
| ***F01P 5/12*** | (2006.01) |
| ***F01P 11/02*** | (2006.01) |

(52) U.S. Cl.
CPC ..... *F01P 11/028* (2013.01); *F01P 5/12* (2013.01); *F01P 2005/125* (2013.01)

(58) Field of Classification Search
CPC ..... F01P 11/028; F01P 5/12; F01P 2005/125
See application file for complete search history.

(56) References Cited

U.S. PATENT DOCUMENTS 3,603,704 A * 9/1971 Zucchinelli ..... H01J 7/18 417/51
4,589,434 A * 5/1986 Kelley ..... F17D 3/14 137/236.1

(Continued)

FOREIGN PATENT DOCUMENTS

DE 38 13 654 A1 11/1989
DE 10 2017 011 428 A1 6/2018

(Continued)

*Primary Examiner* — Anthony Shumate
(74) *Attorney, Agent, or Firm* — Norman B. Thot

(57) ABSTRACT

An automotive electric liquid pump module for pumping a coolant liquid in a coolant circuit of an automobile. The automotive electric liquid pump module includes a first electrical flow pump unit having a flow pump wheel which is directly driven by an electric motor, and a passive deaerator unit having a liquid inlet, a liquid outlet, a deaerator housing which defines a first widened deceleration chamber, and a deaeration opening which is arranged at a vertical top of the first widened deceleration chamber. The deaerator housing is mechanically directly and stiffly connected to the electrical flow pump unit.

6 Claims, 2 Drawing Sheets

(56) References Cited

U.S. PATENT DOCUMENTS

| | | | | |
|---|---|---|---|---|
| 6,017,183 | A * | 1/2000 | Dobler | F04D 29/669 415/55.1 |
| 10,119,544 | B2 * | 11/2018 | Malvasi | F04D 13/0606 |
| 2005/0103286 | A1 * | 5/2005 | Ji | F16H 57/0434 123/196 R |
| 2008/0003116 | A1 * | 1/2008 | Gummersbach | B62D 5/064 417/321 |
| 2016/0365768 | A1 * | 12/2016 | Popov | F04D 13/0633 |
| 2020/0182129 | A1 * | 6/2020 | Lee | F01P 5/12 |
| 2020/0191041 | A1 * | 6/2020 | Surace | F04D 13/06 |
| 2020/0224666 | A1 * | 7/2020 | Keck | F04D 29/046 |
| 2022/0228523 | A1 * | 7/2022 | Buzinov | F01P 7/16 |
| 2023/0349314 | A1 * | 11/2023 | Onoue | F01P 3/202 |
| 2024/0337211 | A1 * | 10/2024 | Fiorini | F04D 13/14 |
| 2025/0327453 | A1 * | 10/2025 | Antchak | F16K 11/0873 |

FOREIGN PATENT DOCUMENTS

| | | | |
|---|---|---|---|
| FR | 2 905 737 | A1 | 3/2008 |
| GB | 510245 | A | 8/1939 |
| GB | 1 485 095 | A | 9/1977 |

* cited by examiner

AUTOMOTIVE ELECTRIC LIQUID PUMP MODULE

CROSS REFERENCE TO PRIOR APPLICATIONS

This application is a U.S. National Phase application under 35 U.S.C. § 371 of International Application No. PCT/EP2021/071666, filed on Aug. 3, 2021. The International Application was published in English on Feb. 9, 2023 as WO 2023/011708 A1 under PCT Article 21 (2).

FIELD

The present invention relates to an automotive electric liquid pump module for pumping a coolant liquid in a coolant circuit of an automobile.

BACKGROUND

Typical liquid coolant circuits in automotive applications are engine coolant circuits for an electrical traction engine or for an internal combustion traction engine, or also traction battery coolant circuits or coolant circuits for secondary devices, for example, for turbochargers, for exhaust gas valves etc. An electric liquid pump module typically comprises an electric motor which directly drives a flow pump wheel which defines a flow pump for relatively high volumetric pumping rates.

The cooling capacity of the coolant liquid and the pumping rate of a flow pump are substantially deteriorated by air bubbles carried with the coolant liquid current. The prior art describes an expansion tank at the vertically highest point of the coolant circuit so that the air bubbles can rise up to the expansion tank. When the electric liquid pump is active and the coolant liquid is circulated in the coolant circuit, however, the air bubbles are carried with the circulating liquid current so that the air bubbles could substantially remain within the circulating liquid current and do not rise to the expansion tank.

SUMMARY

An aspect of the present invention is to provide an efficient automotive electric liquid pump module.

In an embodiment, the present invention provides an automotive electric liquid pump module for pumping a coolant liquid in a coolant circuit of an automobile. The automotive electric liquid pump module includes a first electrical flow pump unit comprising a flow pump wheel which is directly driven by an electric motor, and a passive deaerator unit comprising a liquid inlet, a liquid outlet, a deaerator housing which defines a first widened deceleration chamber, and a deaeration opening which is arranged at a vertical top of the first widened deceleration chamber. The deaerator housing is mechanically directly and stiffly connected to the electrical flow pump unit.

BRIEF DESCRIPTION OF THE DRAWINGS

The present invention is described in greater detail below on the basis of embodiments and of the drawings in which.

DETAILED DESCRIPTION

Figure 1:
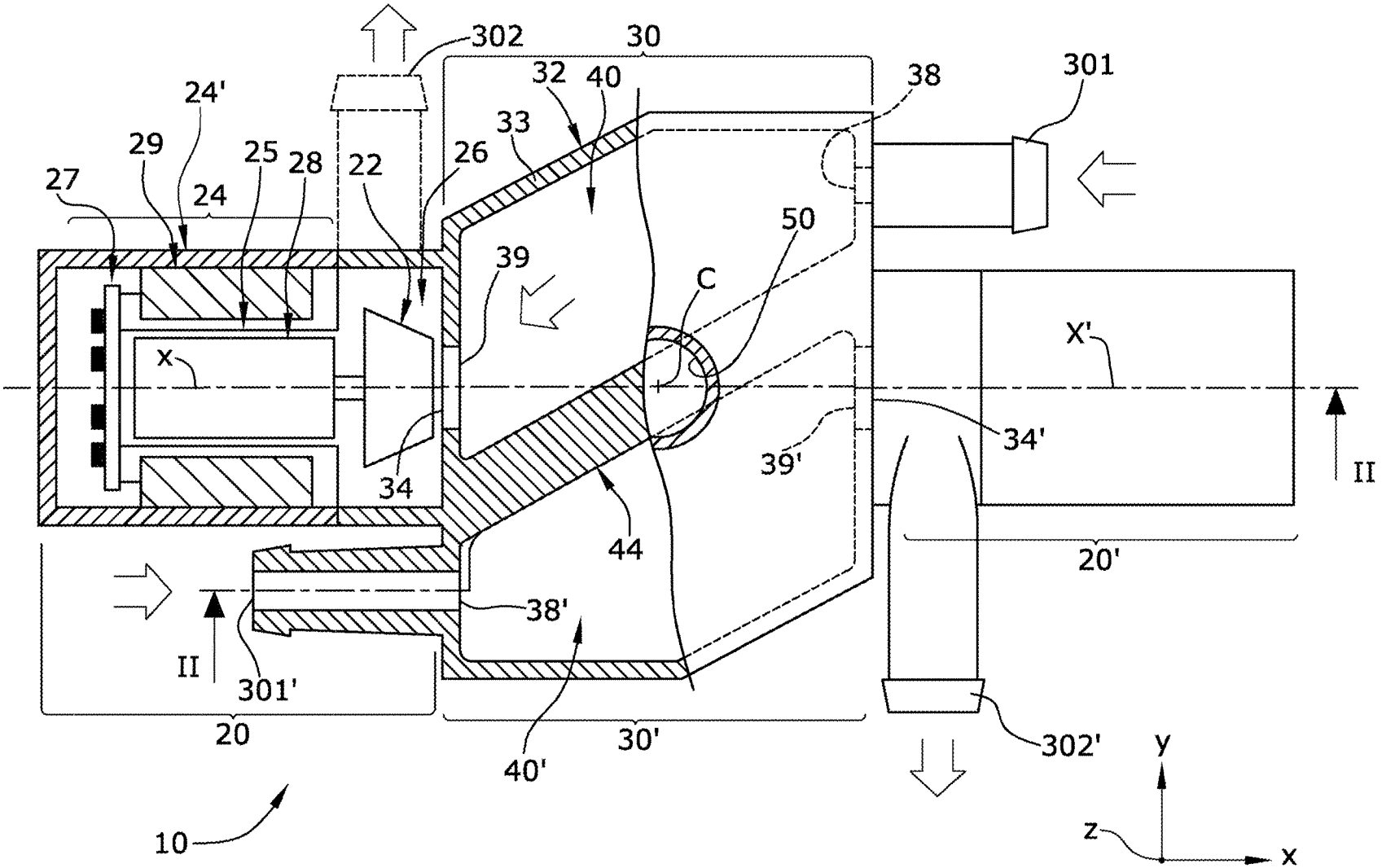
FIG. 1 shows a combined top view and a horizontal longitudinal section I-I of an automotive electric liquid pump module according to the present invention.

The automotive electric liquid pump module of the present invention comprises an electric flow pump unit with a flow pump wheel which is directly driven by an electric motor and a passive deaerator unit with a liquid inlet and with a liquid outlet. The deaerator unit is provided with a deaerator housing which defines a widened deceleration chamber and also a deaeration opening at the vertical top of the deceleration chamber. The deceleration chamber has a cross section which substantially widens from the liquid inlet to the liquid outlet so that the flow velocity of the liquid current is substantially decreased between the liquid inlet and the liquid outlet. Since the flow velocity of the liquid current within the deceleration chamber is substantially reduced, air bubbles carried with the incoming liquid current have enough time to rise within the deceleration chamber up to the deaeration opening at the vertical top of the deceleration chamber so that the air bubbles are separated from the liquid current. The deaeration opening can be fluidically connected to the atmosphere or to an expansion tank. A semipermeable membrane can be provided between the deaeration opening and the atmosphere or the expansion tank, the semipermeable membrane not being permeable for the coolant liquid but being permeable for air.

The widening of the cross section between the liquid inlet and the liquid outlet can be provided stepwise, for example, by providing a rectangular deceleration chamber with a substantially larger cross section than the liquid inlet opening. The cross section can alternatively continuously increase as seen in the general flow direction. The largest cross-section within the deceleration chamber as seen in the general flow direction can, for example, be at least 80% larger, for example, more than 120% larger, than the cross section of the liquid inlet opening.

The deaerator housing defining the deceleration chamber, the liquid inlet opening and the liquid outlet opening, is mechanically directly and stiffly connected to the liquid pump unit, and is in particular is directly connected to a housing part of the liquid pump unit. A housing part of the liquid pump unit can, for example, be a housing part which defines a ring channel radially surrounding the flow pump wheel.

In other words, the electrical flow pump unit and the passive deaerator unit are combined in one single integrated pump module. The fluidic properties of the flow pump unit and of the deaerator unit can be perfectly harmonized because the pump unit and the deaerator unit are fluidically directly connected to each other. Compared to a deaerator unit provided separately and remote from the pump unit, a separate connection tube and a connection device to connect the two units are avoided in the integrated pump module according to the present invention so that the assembly of the automotive coolant circuit is simplified and the number of fluidic interfaces is reduced.

the present invention can also generally be used in non-automotive applications, for example, in a static electronics cooling circuit.

The deaerator unit can, for example, be positioned fluidically upstream of the electric flow pump unit so that a relatively air-bubble-free coolant liquid current enters the electrical flow pump unit, thereby providing that the fluidic efficiency of the flow pump unit is not deteriorated and that the flow pump unit always works efficiently.

The housing main body of the deaerator housing can, for example, define the axial liquid pump inlet opening to axially align with the center of the flow pump wheel. The axial liquid pump inlet opening is axially adjacent to the flow pump wheel. The flow pump wheel can, for example, be an impeller wheel, and the deaerator housing main body can, for example, define an outlet ring channel, for example, a volute-like ring channel, which radially surrounds the flow pump wheel. The deaerator housing main body can, for example, be a plastic body which defines in one integral piece at least four or five side walls of the deceleration chamber and also substantially defines the outlet ring channel so that a separate (plastic) piece for defining the outlet ring channel can be avoided.

The automotive electric liquid pump module can, for example, be a twin pump module and comprises a second and separate electrical flow pump unit and a second widened deceleration chamber which is defined within the same deaerator unit as the first deceleration chamber. The second widened deceleration chamber is substantially separated from the first deceleration chamber so that the coolant flows flowing through the two deceleration chambers are substantially separated from each other and do not substantially mix with each other. The deaerator housing of the deaerator unit defining both deceleration chambers is mechanically directly and stiffly connected to the second flow pump unit. The liquid pump module according to this aspect of the present invention therefore integrates two flow pump units as well as two deaerator units for two separate cooling liquid circuits.

The rotational axis' of both flow pump units can, for example, be provided coaxially with each other, whereas the deaerator unit is arranged axially between the two flow pump units. Since the flow pump units are provided with a motor rotor and a pump rotor both rotating relatively fast, a substantial vibration of the electrical flow pump units is unavoidable, in particular after a certain running time. With the coaxial arrangement of both flow pump units, the vibration behavior of the liquid pump module is less complex and much easier to handle compared to a configuration with a non-coaxial arrangement of the two flow pump units.

The rotational axis' of both flow pump units intersect with the center of gravity of the liquid pump module. This dynamic configuration simplifies the dynamic and vibration behavior of the complete liquid pump module so that the fixation of the liquid pump module at that the automotive structure is simplified and more reliable.

The deaerator unit can, for example, be provided with a single gas outlet opening for both deceleration chambers so that the liquid pump module has only one single gas outlet opening.

One embodiment of the present invention is described below with reference to the enclosed drawings.

Figure 2:
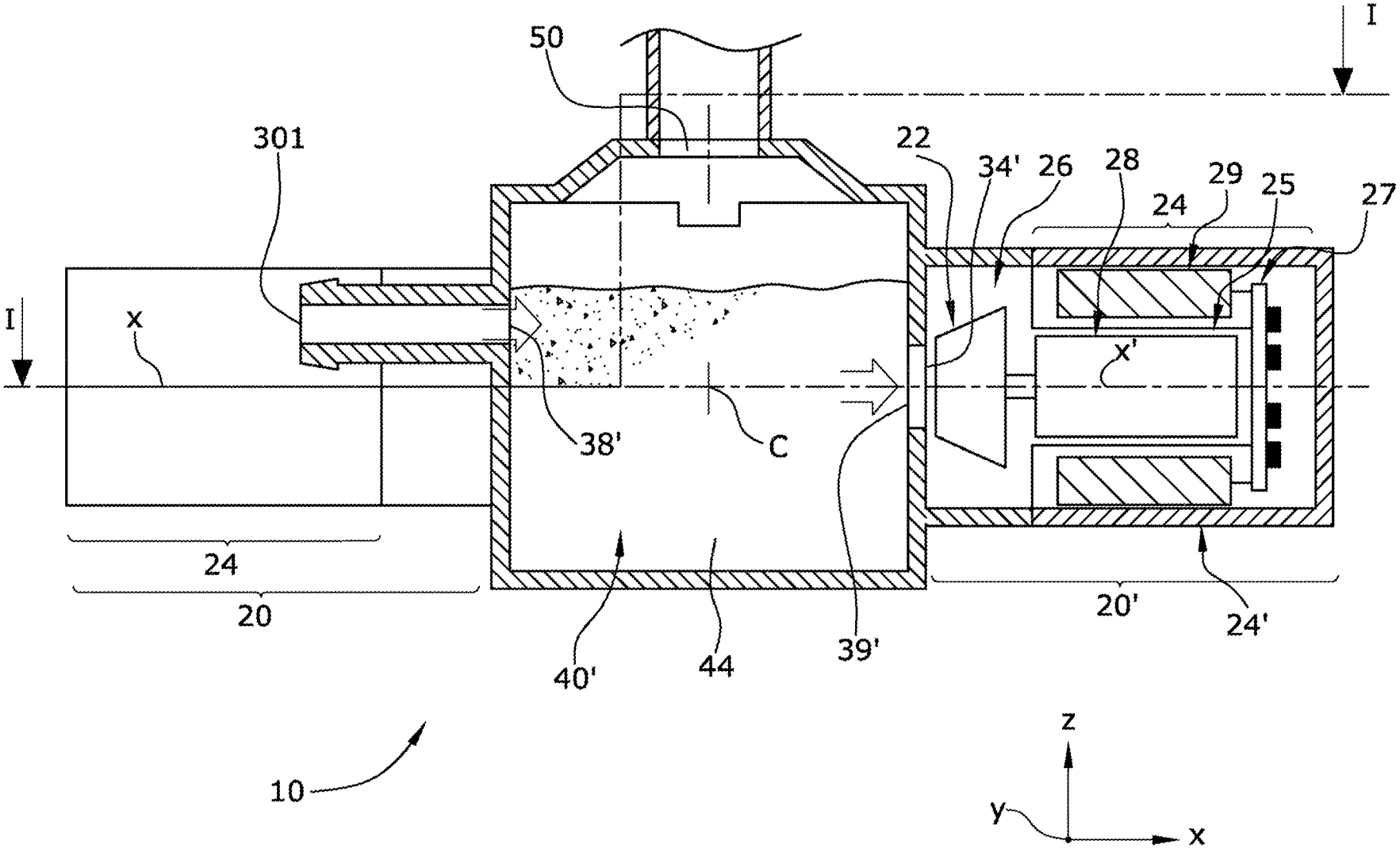
FIG. 2 shows a combined side of view and a vertical longitudinal section II-II of the pump module of FIG. 1.

FIGS. 1 and 2 show an automotive electric liquid pump module 10 integrating two combined deaerator/pump combinations. The pump module 10 is used in an automotive application, which means that low weight, very low production costs, high reliability, high vibration durability and compactness are general requirements for the pump module 10. The pump module 10 is a twin module integrating two combined flow pump unit/deaerator unit combinations in one single pump module 10. The pump module 10 can circulate a coolant liquid in two different coolant circuits, for example, an automotive traction engine cooling circuit and a traction battery cooling circuit.

FIG. 1 shows a top view of two different horizontal planes XY and FIG. 2 shows a side view of different vertical planes XZ of the pump module 10. The pump module 10 comprises a first electrical flow pump unit 20, a fluidically related first passive deaerator unit 30, a second electrical flow pump unit 20', and a fluidically related second passive deaerator unit 30'. From a structural perspective, the first deaerator unit 30 and the second deaerator unit 30' are defined by one single plastic deaerator housing 32 which is made of a suitable plastic deaerator housing main body 33 and a suitable cover body so that the pump module 10 is substantially an assembly of two separate electrical flow pump units 20, 20' and the complete deaerator housing 32.

The two separate electrical flow pump units 20, 20' both have an identical structure, but can alternatively generally be different in their electric and hydraulic performance. In this embodiment, the electrical flow pump units 20, 20' are both provided with an electric can motor 24 having a separation can 25 which separates a wet motor section from a dry motor section. The motor electronics 27 and an electromagnetic motor stator 29 are provided in the dry section, whereas a permanently magnetized motor rotor 28 and a flow pump rotor 22 are provided in the wet section. The motor rotor 28 directly and coaxially drives the flow pump rotor 22 which is provided as an impeller with an axial pump wheel inlet and a radial pump wheel outlet.

The deaerator housing 32 defines a first widened deceleration chamber 40 and a second identical deceleration chamber 40'. The two deceleration chambers 40, 40' do not, however, necessarily need to be identical if the two connected cooling circuits and their cooling performance are not equal. The cross section area of the deceleration chambers 40, 40' dramatically widens after the corresponding liquid inlet 38, 38' by more than 250% in relation to the cross section area of the opening of the corresponding liquid inlet 38, 38' so that the liquid entering the deceleration chamber 40, 40' is dramatically decelerated and flows relatively slowly from the liquid inlet 38, 38' to the corresponding liquid outlet 39, 39'. Air bubbles entering the deceleration chamber 40, 40' together with the coolant liquid therefore have much time to rise to the top region of the deceleration chamber 40, 40', as shown in FIG. 2. The two deceleration chambers 40, 40' are substantially separated from each other by a separation wall 44 so that the coolant liquids of the two deceleration chambers and do not mix with each other.

Both deaerator units 30, 30' have one single common deaeration opening 50 at the vertical top of the two deceleration chambers 40, 40' so that the deceleration chambers 40, 40' are fluidically connected with each other and have the same fluid pressures. Each deaerator unit 30, 30' can alternatively have its own deaeration opening to fluidically completely separate both cooling circuits from each other.

The since the deaerator unit 30, 30' is positioned fluidically upstream of the corresponding electrical flow pump unit 20, 20', the deaerator unit liquid outlet 39, 39' defines the axial liquid pump inlet opening 34, 34' so that a deaerated liquid current axially enters the corresponding electrical pump unit 20, 20'. As can be seen in both drawings, the deaerator housing main body 33 substantially defines the outer circumference wall of the outlet ring channel 26 radially surrounding the corresponding flow pump rotor 22, and also defines the corresponding tangential pump outlet duct with the corresponding pump outlet opening 302, 302'. The deaerator housing main body 33 also defines both inlet ducts 301, 301' respectively leading to the deaerator unit liquid inlets 38, 38'. The deaerator housing main body 33 is directly connected to the motor housing 24'.

As shown in both drawings, the rotational axis' X, X' of both electrical flow pump units 20, 20' are provided perfectly coaxially with each other. The rotational axis' X, X' of both electrical flow pump units 20, 20' additionally perfectly intersect with the center of gravity C of the complete liquid pump module 10.

The present invention is not limited to embodiments described herein; reference should be had to the appended claims.

LIST OF REFERENCE NUMERALS

10 Automotive electric liquid pump module/Pump module
20 First electrical flow pump unit
20' Second electrical flow pump unit
22 Flow pump rotor
24 Electric can motor
24' Motor housing
25 Separation can
26 Outlet ring channel
27 Motor electronics
28 Motor rotor
29 Electromagnetic motor stator
30 First passive deaerator unit
30' Second passive deaerator unit
32 Deaerator housing
33 Deaerator housing main body
34 Axial liquid pump inlet opening
34' Axial liquid pump inlet opening
38 Liquid inlet
38' Liquid inlet
39 Liquid outlet
39' Liquid outlet
40 First deceleration chamber
40' Second deceleration chamber
44 Separation wall
50 Deaeration opening
301 Inlet duct
301' Inlet duct
302 Pump outlet opening
302' Pump outlet opening
C Center of gravity
X' Rotational axis
X" Rotational axis

What is claimed is:

1. An automotive electric liquid pump module for pumping a coolant liquid in a coolant circuit of an automobile, the automotive electric liquid pump module comprising:

a first electrical flow pump unit comprising a flow pump wheel which is directly driven by an electric motor;

a passive deaerator unit comprising a liquid inlet, a liquid outlet, a deaerator housing which defines a first widened deceleration chamber, and a deaeration opening which is arranged at a vertical top of the first widened deceleration chamber; and a second electrical flow pump unit which is fluidically separated from the first electrical flow pump unit, wherein, the deaerator housing is mechanically directly and stiffly connected to the electrical flow pump unit, the passive deaerator unit further comprises a second widened deceleration chamber which is substantially separated from the first widened deceleration chamber, the deaerator housing is further mechanically directly and stiffly connected to the second electrical flow pump unit, the first electrical flow pump unit has a rotational axis, the second electrical flow pump unit has a rotational axis, and the rotational axis of the first electrical flow pump unit is arranged so as to be coaxial with the rotational axis of the second electrical flow pump unit.

2. The automotive electric liquid pump module as recited in claim 1, wherein the passive deaerator unit is arranged fluidically upstream of the first electrical flow pump unit.

3. The automotive electric liquid pump module as recited in claim 1, wherein, the deaerator housing comprises a deaerator housing main body, and the deaerator housing main body defines an axial liquid pump inlet opening which is axially adjacent to the flow pump wheel.

4. The automotive electric liquid pump module as recited in claim 3, wherein, the flow pump wheel is an impeller wheel, and the deaerator housing main body defines an outlet ring channel which radially surrounds the flow pump wheel.

5. The automotive electric liquid pump module as recited in claim 1, wherein, the automotive electric liquid pump module has a center of gravity, and the rotational axis of both the first electrical flow pump unit and of the second electrical flow pump unit intersect with the center of gravity of the liquid pump module.

6. The automotive electric liquid pump module as recited in claim 1, wherein the deaeration opening is provided for both the first widened deceleration chamber and for the second widened deceleration chamber.

* * * * *